US007798543B1

(12) United States Patent
Gordon et al.

(10) Patent No.: US 7,798,543 B1
(45) Date of Patent: Sep. 21, 2010

(54) SECURITY LOCKING DEVICE

(76) Inventors: Janet L. Gordon, 7201 N. 17th Ave., Phoenix, AZ (US) 85021; Harriet A. Klein, 11438 N. 30th Ave., Phoenix, AZ (US) 85029

( * ) Notice: Subject to any disclaimer, the term of this patent is extended or adjusted under 35 U.S.C. 154(b) by 0 days.

(21) Appl. No.: 12/372,228

(22) Filed: Feb. 17, 2009

Related U.S. Application Data

(60) Provisional application No. 61/066,241, filed on Feb. 19, 2008.

(51) Int. Cl.
*B65D 27/30* (2006.01)
*E05B 39/02* (2006.01)

(52) U.S. Cl. ..... 292/307 R; 292/328

(58) Field of Classification Search ..... 292/307 R, 292/307 A, 307 B, 315, 317–321, 328–331; 70/456 R, 457, 459, 20, 30, 456 B, 458, 49, 70/51, 52, 54–56; 24/3.11, 3.12, 600.2, 601.1, 24/601.3, 709.8, 711.1
See application file for complete search history.

(56) References Cited

U.S. PATENT DOCUMENTS 377,108 A * 1/1888 Jenkins ..... 24/710
1,048,837 A * 12/1912 Jessup ..... 292/318
1,173,603 A * 2/1916 Murray et al. ..... 292/318
1,188,811 A * 6/1916 Mosel ..... 292/317
1,369,506 A * 2/1921 Voight ..... 70/455
1,937,743 A * 12/1933 Brooks ..... 292/328
2,297,623 A * 9/1942 Hickman ..... 224/103
2,459,405 A * 1/1949 Anderson ..... 70/459
2,833,447 A * 5/1958 Thiele ..... 222/151
2,875,495 A * 3/1959 Hans et al. ..... 24/598.4
3,299,679 A * 1/1967 Anderson ..... 70/459
4,164,132 A * 8/1979 Loman ..... 70/456 R
D303,997 S * 10/1989 Grossiord ..... D3/211
5,059,016 A * 10/1991 Lawassani et al. ..... 359/871
5,762,386 A * 6/1998 Fuehrer ..... 292/307 R
6,481,765 B1 * 11/2002 Jelavic ..... 292/307 R
6,578,887 B1 * 6/2003 Kienzler ..... 292/321
6,869,113 B2 * 3/2005 Burt ..... 292/307 R
7,370,892 B2 * 5/2008 Collingham ..... 292/329

* cited by examiner

*Primary Examiner*—Peter M Cuomo
*Assistant Examiner*—Alyson M Merlino
(74) *Attorney, Agent, or Firm*—Parsons & Goltry; Michael W. Goltry; Robert A. Parsons

(57) ABSTRACT

A security locking device includes a clasp, a tension spring having a first tag end affixed to the clasp and a second tag end movable between an open position released from the clasp forming an open loop and a closed position retained by the clasp forming a closed loop, a clasp cover mounted to the clasp for movement between a first position away from the clasp and a second position enclosing the clasp, the first tag end of the tension spring, and the second end of the tension spring in the closed position thereof retained by the clasp forming the closed loop. The tension biases the second tag end into the open position.

14 Claims, 4 Drawing Sheets

SECURITY LOCKING DEVICE

FIELD OF THE INVENTION

The present invention relates to locks used to secure personal items from theft and unauthorized use.

BACKGROUND OF THE INVENTION

Securing personal property from unauthorized use and theft is a long-standing problem and one that is not easily solved. Beyond hiding personal property or vigilantly guarding them, a common practice is to secure them with a lock. Among the various types of available locks are bicycle locks, keycard locks, electronic locks, padlocks, rim locks, time locks, etc. While such locks are suitable and work well, they are expensive, difficult to construct, and not practical for use in assisting people in securing their purses, small bags, keychains, and other small personal items from theft or unauthorized sue while shopping or simply moving about in the normal course of the day.

SUMMARY OF THE INVENTION

According to the principle of the invention, a security locking device includes a clasp, a substantially U-shaped member having a first tag end affixed to the clasp and a second tag end movable between an open position released from the clasp forming an open loop and a closed position retained by the clasp forming a closed loop, and a clasp cover mounted to the clasp for movement between a first position away from the clasp and a second position enclosing the clasp, the first tag end of the substantially U-shaped member, and the second end of the substantially U-shaped member in the closed position thereof retained by the clasp forming the closed loop. An opening is formed in the clasp cover through which the clasp passes in response to movement of the clasp cover between the first and second positions with respect to the clasp. A cam is formed between the clasp and the clasp cover to interact between the clasp and the clasp cover to maintain the clasp cover in the second position. A connector has a first end affixed to the clasp cover and an opposed second end mounted to the clasp for pivotal movement of the clasp cover between the first and second positions of the clasp cover. The cam is formed in the second end of the connector. The first tag end of the substantially U-shaped member extends into, and is secured within, a socket formed in the clasp. A bias is applied to the second tag end of the substantially U-shaped member biasing the second tag end of the substantially U-shaped member in the open position.

According to the principle of the invention, a security locking device includes a clasp, a tension spring having a first tag end affixed to the clasp and a second tag end movable between an open position released from the clasp forming an open loop and a closed position retained by the clasp forming a closed loop, and a clasp cover. The clasp cover is mounted to the clasp for movement between a first position away from the clasp and a second position enclosing the clasp, the first tag end of the tension spring, and the second end of the tension spring in the closed position thereof retained by the clasp forming the closed loop. The tension biases the second tag end into the open position. An opening is formed in the clasp cover through which the clasp passes in response to movement of the clasp cover between the first and second positions with respect to the clasp. A cam is formed between the clasp and the clasp cover to interact between the clasp and the clasp cover to maintain the clasp cover in the second position. A connector has a first end affixed to the clasp cover and an opposed second end mounted to the clasp for pivotal movement of the clasp cover between the first and second positions of the clasp cover. The cam is formed in the second end of the connector. The first tag end of the substantially U-shaped member extends into, and is secured within, a socket formed in the clasp.

According to the principle of the invention, a security locking device includes a clasp, a tension spring having a first tag end affixed to the clasp and a second tag end movable between an open position released from the clasp forming an open loop and a closed position retained by the clasp forming a closed loop, the tension biasing the second tag end into the open position, and a clasp cover formed with a cam surface. A connector has a first end affixed to the clasp cover and an opposed second end mounted to the clasp for pivotal movement of the clasp cover between a first position away from the clasp and a second position enclosing the clasp, the first tag end of the tension spring, and the second end of the tension spring in the closed position thereof retained by the clasp forming the closed loop. A cam is formed in the second end of the connector to interact with the cam surface formed in the clasp to maintain the clasp cover in the second position. The first tag end of the substantially U-shaped member extends into, and is secured within, a socket formed in the clasp. An opening is formed in the clasp cover through which the clasp passes in response to movement of the clasp cover between the first and second positions with respect to the clasp.

BRIEF DESCRIPTION OF THE DRAWINGS

Referring to the drawings.

DETAILED DESCRIPTION OF PREFERRED EMBODIMENTS

Figure 1:
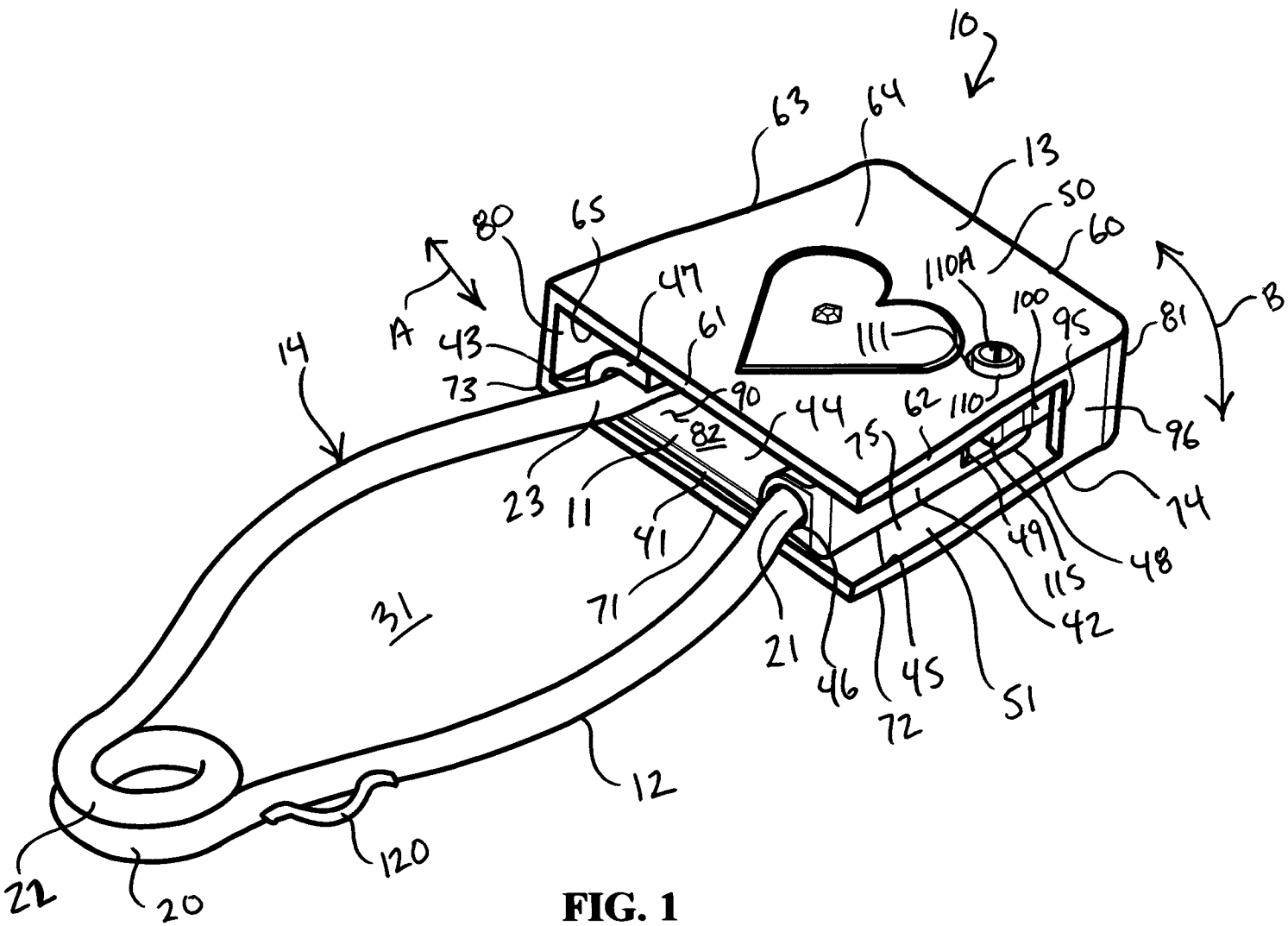
FIG. 1 is a perspective view of a security locking device shown as it would appear closed.
Figure 2:
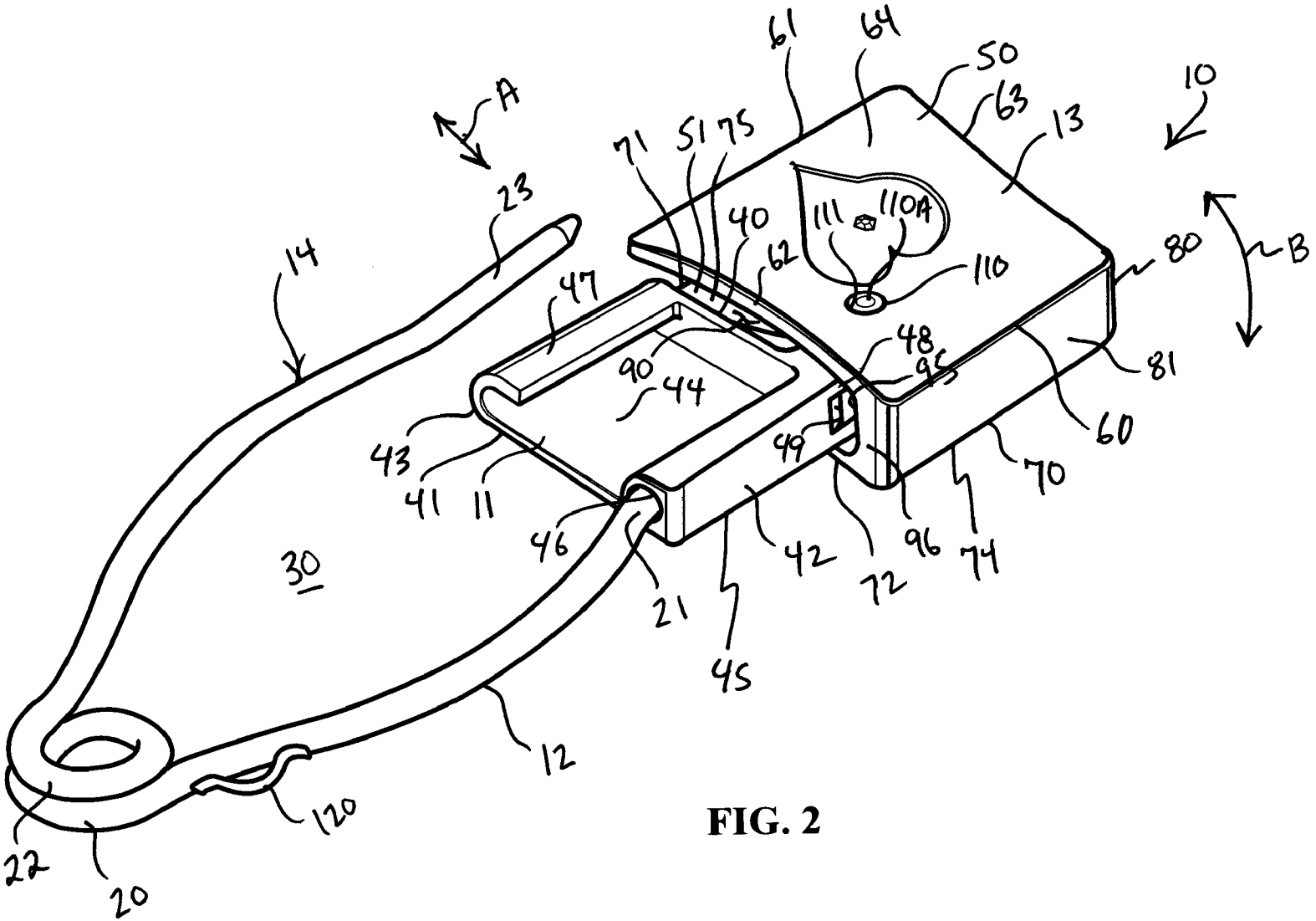
FIG. 2 is a perspective view of the security locking device shown as it would appear open.
Figure 3:
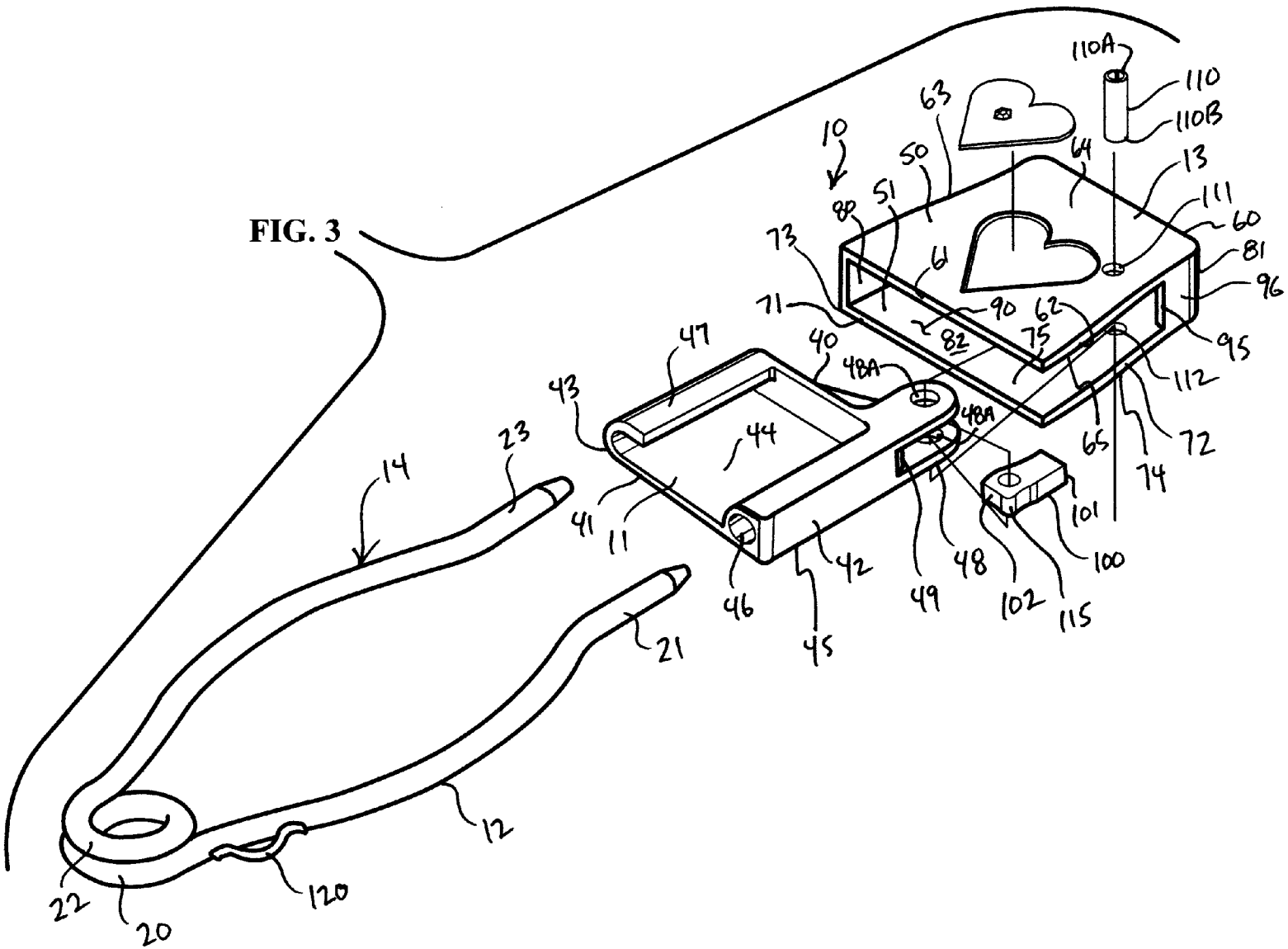
FIG. 3 is an exploded perspective view of the security locking device of FIG. 1.

Turning now to the drawings, in which like reference characters indicate corresponding elements throughout the several views, attention is directed to FIGS. 1-3 in which there is seen a security locking device 10 including a clasp 11, a tension spring 12, and a clasp cover 13. Tension spring 12 includes a wire formed into coils 20 and 22. In this specific embodiment, tension spring 12 has two active coils 20 and 22. Coil 20 leads to a tag end 21, and coil 22 leads to tag end 23. Because tension spring 12 includes two active coils 20 and 22, coils 20 and 22 are outermost coils. If desired, one or more additional coils can be provided between coils 20 and 22. Tension spring 12 is fashioned of spring steel, a nickel-based spring alloy, or other material or combination of materials having a substantially constant moduli of elasticity as is typical with tension springs. Tension spring 12 is formed of a shape generally representative of a substantially U-shaped member denoted generally at 14.

Tag end 21 is rigidly affixed to clasp 11. Tag end 23 is free, and is movable between an open position illustrated in FIGS. 2 and 5 released from clasp 11 forming an open loop 30, and a closed position retained by clasp illustrated in FIGS. 1 and 4 forming a closed loop 31. Coils 20 and 22 bias tag end 23 of tension spring 12 into the open position illustrated in FIGS. 2 and 5. Clasp cover 13 is mounted to clasp 11 for movement between a first or open position away from clasp 11 illustrated in FIGS. 2 and 5, and a second or closed position toward clasp 11 illustrated in FIGS. 1 and 4 enclosing clasp 11, tag end 21 of tension spring 12, and tag end 23 of tension spring 12 in the closed position thereof retained by clasp 11 forming closed loop 31.

Figure 5:
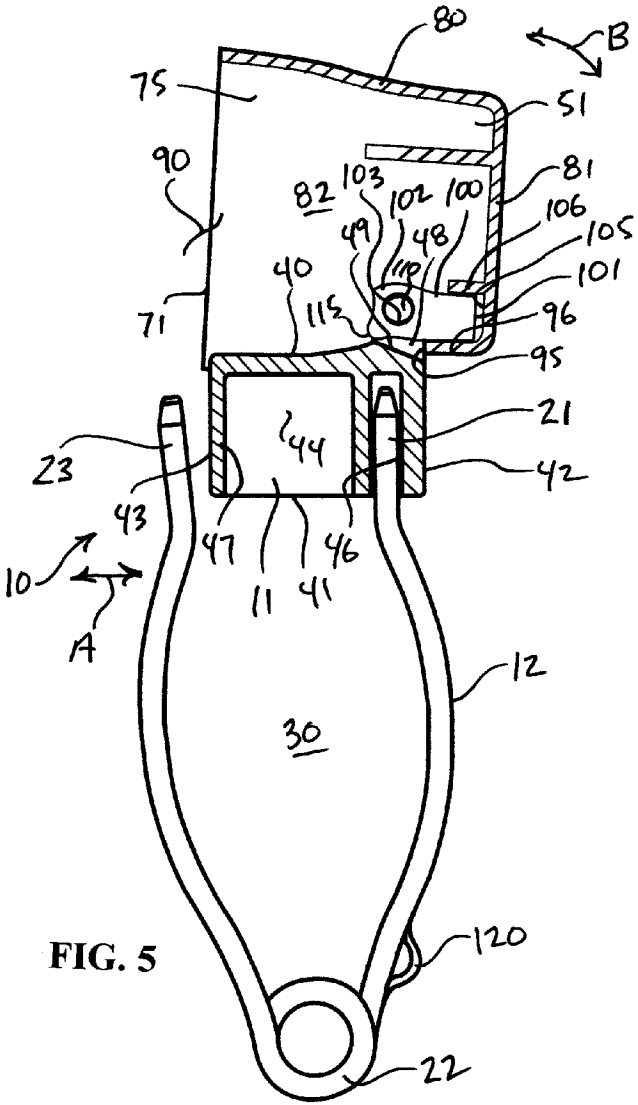
FIG. 5 is a partial vertical sectional view of the security locking device of FIG. 1 shown as it would appear open.
Figure 4:
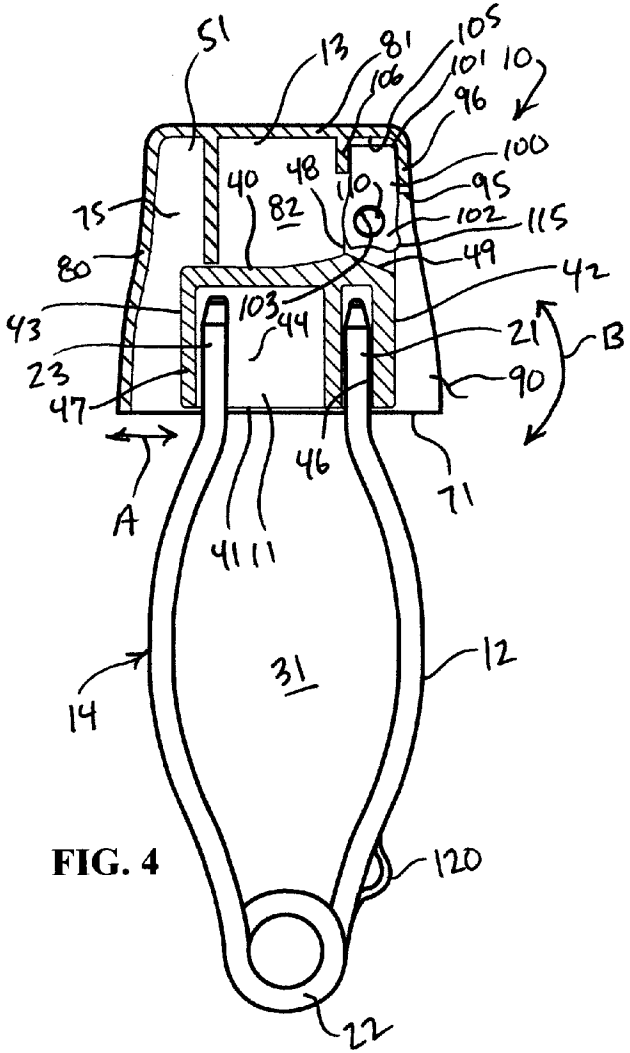
FIG. 4 is a partial vertical sectional view of the security locking device of FIG. 1 shown as it would appear closed.

Referencing FIGS. 2 and 3, clasp 11 is a broad, substantial body formed of steel, aluminum, titanium, or other similarly strong, rigid material or combination of materials, and is integrally formed or formed of two or more parts joined, such as by welding. Clasp 11 has opposed upper and lower ends 40 and 41, opposed sides 42 and 43, and opposed upper and lower faces 44 and 45. A blind bore or socket 46 is formed in side 42 of clasp 11, and an opposed catch 47 is formed in side 43 of clasp 11. Side 43 of clasp 11 is in-turned in the present embodiment forming catch 47 consisting of a substantially U-shaped channel directed inwardly toward side 43 of clasp 11. Socket 46 and catch 47 are substantially parallel with respect to each other. Socket 46 extends substantially from lower end 41 of clasp 11 to upper end 40 of clasp 11, and catch 47 likewise extends substantially from lower end 41 of clasp 11 to upper end 40 of clasp 11. Tag end 21 extends into, and is secured or otherwise affixed to, socket 46 as best illustrated in FIGS. 4 and 5. A bracket 48 is formed in upper end 40 of clasp 11 proximate to side 42 of clasp 11, and which extends upwardly and away from upper end 40 of clasp 11. As best illustrated in FIGS. 4 and 5, bracket 48 extends upwardly and away from a cam surface 49 formed in upper end 40 of clasp 11.

Tag end 21 is rigidly affixed to clasp 11, as previously explained. In the present embodiment, tag end 21 is press fit into socket 46 to rigidly affix tag end 21 to clasp 11 proximate to side 42 of clasp 11. If desired, tag 21 end may be welded in place within socket 46, or rigidly affixed in place within socket 46 with any suitable form of mechanical fastener. In other embodiments, tag end 21 may be integrally formed with clasp 11, welded to clasp 11, or the like.

Tag end 21 of tension spring 12 extends outwardly away from socket 46 from lower end 41 of clasp 11 and extends to coil 20 illustrated in FIGS. 1-3. Coil 20, in turn, leads to coil 22 which, in turn, leads to tag end 23 that extends back to clasp 11 to extend alongside side 43 of clasp 11. Tag end 23 is free as previously disclosed, and is movable in side-to-side with respect to side 43 of clasp 11 as denoted generally by the double arrowed line A in FIGS. 1, 2, 4 and 5 between a first or open position illustrated in FIGS. 2 and 5 away from clasp 11, and a second or closed position toward clasp 11 illustrated in FIGS. 1 and 4.

In the first or open position of tag end 23 with respect to clasp 11, tag end 23 is moved away from side 43 of clasp 11 and is released from clasp 11 and is positioned outboard and away from side 43 of clasp 11 and catch 47 formed in side 43 of clasp 11 forming open loop 30. In the first or open position of tag end 23, tag end 23 is maintained in its open position with respect to clasp 11 and coils 20 and 22 of tension spring 12 are entirely relaxed. In the second or closed position of tag end 23 with respect to clasp 11, tag end 23 is moved from its open position away from side 43 of clasp 11 toward side 43 of clasp 11 and past catch 47 and is positioned proximate to upper face 44 of catch between catch 47 and side 42 of clasp 11 so as to register with catch 47, and then is set into catch 47 to thereby retain tag end 23 to clasp 11 at catch 47 forming closed loop 31, which is formed by and between clasp 11 and tension spring 12 in the closed position of tag end 23 of tension spring 12.

Tag end 23 of tension spring 12 is moved by hand between its open and closed positions. To move tag end 23 from its open position illustrated in FIGS. 2 and 5 to its closed position illustrated in FIGS. 1 and 4, one need only apply sufficient force to overcome the bias applied by coils 20 and 22 of tension spring 12 much like a conventional safety pin. To move tag end 23 of tension spring 12 from its closed position with respect to clasp 11 illustrated in FIGS. 1 and 4 to its open position with respect to clasp 11 illustrated in FIGS. 2 and 5, one need only apply sufficient force against tag end 23 of tension spring 12 to reverse the operation of moving tag end 23 from its open position to its closed position with respect to clasp 11. In the closed position of tag end 23 of tension spring 12 retained to clasp 11 with catch 47, the outward bias applied to tag end 23 by coils 20 and 22 of tension spring 12 urge tag end 23 away from side 43 of clasp 11 and against catch 47 to competently secure tag end 23 to clasp 11 in the closed position of tag end 23 received and retained by catch 47.

It has been previously disclosed that clasp cover 13 is mounted to clasp 11 for movement between a first or open position away from clasp 11 illustrated in FIGS. 2 and 5, and a second or closed position toward clasp 11 illustrated in FIGS. 1 and 4 enclosing clasp 11, tag end 21 of tension spring 12, and tag end 23 of tension spring 12 in the closed position thereof retained by clasp 11 forming closed loop 31. Considering now the structure of clasp cover 13 with reference to FIGS. 1-5, clasp cover is a broad, substantial body formed of steel, aluminum, titanium, or other similarly strong, rigid material or combination of materials, and is integrally formed or formed of two or more parts joined, such as by welding. Clasp cover 13 includes opposed, confronting, parallel, coextensive plates 50 and 51. Plate 50 has opposed, substantially parallel upper and lower edges 60 and 61, opposed, substantially parallel side edges 62 and 63, and opposed outer and inner faces 64 and 65. Plate 51 has opposed, substantially parallel upper and lower edges 70 and 71, opposed, substantially parallel side edges 72 and 73, and opposed outer and inner faces 74 and 75. Inner face 65 of plate 50 opposes and is substantially parallel with respect to inner face 75 of plate 51.

An endwall 80 is coupled between side edges 63 and 73 of plates 50 and 51, respectively, and a top wall 81 is coupled between upper edges 60 and 70 of plates 50 and 51, respectively. Endwall 80 extends from lower edges 61 and 71 of plates 50 and 51, respectively, to top wall 81 at the juncture between side edges 63 and 73 of plates 50 and 51, respectively, and upper edges 60 and 70 of plates 50 and 51, respectively. Top wall 81, in turn, extends from end wall 80 at the juncture between side edges 63 and 73 of plates 50 and 51, respectively, to the juncture of upper edges 60 and 70 of plates 50 and 51, respectively, and side edges 62 and 72 of plates 50 and 51, respectively. Opposed inner faces 65 and 75 of plates 50 and 51, respectively, end wall 80, and top wall 81 cooperate together to form an internal area or volume 82 of clasp cover 13. For reference purposes, top wall 81 forms the upper end of clasp cover 13 and lower edges 61 and 71 of plates 50 and 51, respectively, form the opposed lower end of clasp cover 13, while end wall 80 forms one side of clasp cover 13 opposing side edges 62 and 72 of plates 50 and 51, respectively, forming the opposing side of clasp cover 13.

Clasp 11 is positioned in volume 82, and clasp cover 13 is mounted to clasp 11 for pivotal movement indicated by the arcuate double arrowed line B denoted in FIGS. 1, 2, 4, and 5, at a pivot point between a first or open position away from clasp 11 and volume 82 illustrated in FIGS. 2 and 5, and a second or closed position toward clasp 11 and into volume 82 illustrated in FIGS. 1 and 4 enclosing in volume 82 clasp 11, tag end 21 of tension spring 12, and tag end 23 of tension spring 12 in the closed position thereof retained by clasp 11 forming closed loop 31. In the open position of clasp cover 13, clasp 11 is substantially completely exposed, including tag end 23 of tension spring 12, thereby allowing a user to manipulate tag end 23 of tension spring 12 to move tag end 23 between its open position as illustrated in FIGS. 2 and 5, and its closed position as illustrated in FIGS. 1 and 4. With clasp cover 13 in its open position and tag end 23 of tension spring 12 in its open position forming open loop 30, one or more selected items to be held or retained by security locking device 10 may be admitted onto open loop 30 between the gap formed between tag end of tension spring 12 and clasp 11, after which tag end 23 may be moved to its closed positioned retained by clasp 11 forming closed loop 31 to retain the admitted items. At this point, clasp cover 13 may be pivoted from its open position to its closed position as illustrated in FIGS. 1 and 4 enclosing in volume 82 clasp 11, tag end 21 of tension spring 12, and tag end 23 of tension spring 12. The admitted and retained items may be removed or otherwise released with respect to security locking device 10 simply by reversing the foregoing operation.

When clasp cover 13 is closed enclosing in volume clasp 11, tag end 21 of tension spring 12, and tag end 23 of tension spring 12, clasp cover 13 prevents access to tag end 23 preventing tag end from 23 being moved from its closed position to its open position thereby preventing unauthorized or unintended movement of tag end 23 out of its closed position and into its open position to, in turn, prevent removal of the one or more items retained by security locking device 10. Moreover, when clasp cover 13 is closed enclosing in volume clasp 11, tag end 21 of tension spring 12, and tag end 23 of tension spring 12, clasp cover 13 substantially encloses, covers, and substantially conceals from view clasp 11, tag end 21 of tension spring 12, and tag end 23 of tension spring 12, thereby impairing visual access to clasp 11 and tag 23 of tension spring 12 by onlookers to thus deter would-be thieves from visually, and without touching or attempting to physically manipulate security locking device 10, learning how to operate security locking device 10 to remove the items held by security locking device 10.

Security locking device 10 may be used to secure a keychain to a belt or belt loop to secure the keychain and any keys held thereby with respect to the belt or belt loop, a purse to a shopping cart to secure the purse with respect to the shopping cart, etc. Security locking device 10 does not include a combination locking system or key locking mechanism, which eliminates the need for user to remember the combination code in the case of a combination lock. or retain a required key in the case of a key locking mechanism.

An opening 90 is formed in clasp cover 13, through which clasp 11 passes in response to movement of clasp cover 13 between the open and closed positions of clasp cover 13. Opening 90 extends into volume 82, extends along the lower end of clasp cover 13 and the side of clasp cover 13 opposing end wall 80, and is positioned with respect to the pivot point between clasp cover 13 and clasp 11 to permit clasp cover 13 to move between its closed position illustrated in FIGS. 1 and 4, and its open position illustrated in FIGS. 2 and 5. In the present embodiment, opening 90 is formed in the lower end of clasp cover 13 by and between lower edges 61 and 71 of plates 50 and 51, respectively, which extends from end wall 80 at the juncture between side edges 63 and 73 of plates 50 and 51, respectively, and lower edges 61 and 71 of plates 50 and 51, respectively, to the juncture between side edges 62 and 72 of plates 50 and 51, respectively, and lower edges 61 and 71 of plates 50 and 51, respectively. Opening 90 is further formed in the side of clasp cover 13 opposing end wall 80, and is formed by and between side edges 62 and 72 of plates 50 and 51, respectively, which extends from the juncture between side edges 62 and 72 of plates 50 and 51, respectively, and lower edges 61 and 71 of plates 40 and 51, respectively, to an edge 95 of a cropped end wall 96 formed in the side of clasp cover 13 just inboard of the juncture between side edges 62 and 72 of plates 50 and 51, respectively, and upper edges 60 and 70 of plates 50 and 51, respectively.

Referencing FIGS. 4 and 5, clasp cover 13 incorporates a connector 100, which is used to pivotally attach clasp cover 13 to clasp 11. Connector 100 is positioned in volume 82 and has an inner or proximal end 101 rigidly affixed to clasp cover 13, and an opposing outer or distal end 102. Proximal end 101 is located at the side of clasp cover 13 at the juncture between side edges 62 and 72 of plates 50 and 51, respectively, and upper edges 60 and 70 of plates 50 and 51, respectively, proximate to top wall 81 and is held in a socket 105 formed between the inner surface of cropped end wall 96 and an opposed, substantially parallel finger 106 extending into volume 82 away from the inner surface of top wall 81. Proximal end 101 of connector 100 is rigidly affixed to clasp cover 13. In the present embodiment, proximal end 101 is press fit into socket 105 to rigidly affix proximal end 101 to clasp cover 13. If desired, proximal end 101 may be welded in place within 105, or rigidly affixed in place within socket 105 with any suitable form of mechanical fastener. In other embodiments, proximal end 101 may be integrally formed with clasp cover 13, welded to clasp cover 13, or the like.

Connector 100 extends from proximal 101 located proximate to top wall 80 downwardly in volume 82 to distal end 102 directed toward the lower end of clasp cover 13, and is substantially parallel with respect to end wall 80 and cropped end wall 96. Distal end 102 of connector 100 extends to bracket 48, and is mounted to bracket 48 for pivotal movement of clasp cover 13 between its open and closed position with a pivot pin 110. With additional reference to FIG. 3, distal end 102 of connector 100 is formed with an opening 103 that is registered with opposed openings 111 and 112 formed in plates 50 and 51, respectively. Bracket 48 is bifurcated and is formed with opposed openings 48A and 48B. Pivot pin 110 has opposed ends 110A and 110B, and extends through opening 103 formed in distal end 102 of connector 100. An intermediate portion of pivot pin 110 between ends 110A and 110B is rigidly affixed to distal end 102 of connector 100 at opening 103, such as by press-fitting, welding, etc. End 110A of pivot pin 110 extends concurrently through opening 48A formed in one side of bracket 48 and opening 111 formed in plate 50, and the opposed end 110B of pivot pin 110 extends concurrently through opening 48B formed in the opposed side of bracket 48 and opening 112 formed in plate 51. This arrangement secures clasp cover 13 to clasp 11, and forms the pivotal coupling, and thus the pivot point, between clasp cover 13 and clasp 11.

Because connector 100 is rigidly affixed to clasp cover 13, connector 100 moves with clasp cover 13 as clasp cover 13 is moved between its open and closed positions. Referencing FIGS. 4 and 5, distal end 102 of connector 100 is formed with a cam 115, and upper end 40 of clasp 11 is formed with cam surface 49. Bracket 48 extends away from cam surface 49 formed in upper end 40 of clasp 11. In the closed position of clasp cover 13, cam 115 confronts cam surface 49. In response to the initiation of movement of clasp cover 13 out of its closed position illustrated in FIG. 4 toward its open position cam 115 interacts with cam surface 49. In response to the proper amount of force, the interaction between cam 115 and cam surface 115 can be overcome thereby allowing a user to freely move cap cover 13 between its open and closed position. However, when clasp cover 13 is in its closed position, the interaction between cam 115 and cam surface 49 inhibits clasp cover 13 from inadvertently moving out of its closed position and into its open position.

As illustrated in FIGS. 1-5, tension spring 12 is formed with an auxiliary loop 120. Loop 120 is an engagement point onto which decorative attachments, pendants, or the like, may be hooked onto as may be desired. Although one auxiliary loop 120 is provided, more can be incorporated into security locking device 10 if so desired.

The invention has been described above with reference to a preferred embodiment. However, those skilled in the art will recognize that changes and modifications may be made to the embodiment without departing from the nature and scope of the invention. Various changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. A security locking device, comprising:

a clasp;

a substantially U-shaped member having a first tag end affixed to the clasp and a second tag end movable between an open position released from the clasp forming an open loop and a closed position retained by the clasp forming a closed loop; and a clasp cover mounted to the clasp for pivotal movement between a first position away from the clasp and a second position toward the clasp enclosing the clasp, the first tag end of the substantially U-shaped member, and the second tag end of the substantially U-shaped member in the closed position thereof retained by the clasp forming the closed loop.

2. The security locking device according to claim 1, further comprising an opening formed in the clasp cover through which the clasp passes in response to movement of the clasp cover between the first and second positions with respect to the clasp.

3. The security locking device according to claim 1, further comprising a cam formed between the clasp and the clasp cover interacting between the clasp and the clasp cover to maintain the clasp cover in the second position.

4. The security locking device according to claim 3, further comprising:

a connector having a first end affixed to the clasp cover and an opposed second end mounted to the clasp for pivotal movement of the clasp cover between the first and second positions of the clasp cover; and the cam is formed in the second end of the connector.

5. The security locking device according to claim 1, wherein the first tag end of the substantially U-shaped member extends into, and is secured within, a socket formed in the clasp.

6. The security locking device according to claim 1, further comprising the substantially U-shaped member biasing the second tag end of the substantially U-shaped member in the open position.

7. A security locking device, comprising:

a clasp;

a tension spring having a first tag end affixed to the clasp and a second tag end movable between an open position released from the clasp forming an open loop and a closed position retained by the clasp forming a closed loop;

a clasp cover mounted to the clasp for pivotal movement between a first position away from the clasp and a second position toward the clasp enclosing the clasp, the first tag end of the tension spring, and the second tag end of the tension spring in the closed position thereof retained by the clasp forming the closed loop concealing from view the clasp, the first tag end of the tension spring, and the second tag end of the tension spring in the closed position thereof retained by the clasp forming the closed loop; and the tension spring biasing the second tag end into the open position.

8. The security locking device according to claim 7, further comprising an opening formed in the clasp cover through which the clasp passes in response to movement of the clasp cover between the first and second positions with respect to the clasp.

9. The security locking device according to claim 7, further comprising a cam formed between the clasp and the clasp cover interacting between the clasp and the clasp cover to maintain the clasp cover in the second position.

10. The security locking device according to claim 9, further comprising:

a connector having a first end affixed to the clasp cover and an opposed second end mounted to the clasp for pivotal movement of the clasp cover between the first and second positions of the clasp cover; and the cam is formed in the second end of the connector.

11. The security locking device according to claim 7, wherein the first tag end of the tension spring extends into, and is secured within, a socket formed in the clasp.

12. A security locking device, comprising:

a clasp;

a tension spring having a first tag end affixed to the clasp and a second tag end movable between an open position released from the clasp forming an open loop and a closed position retained by the clasp forming a closed loop, the tension spring biasing the second tag end into the open position;

a clasp cover formed with a cam surface;

a connector having a first end affixed to the clasp cover and an opposed second end mounted to the clasp for pivotal movement of the clasp cover between a first position away from the clasp and a second position toward the clasp enclosing the clasp, the first tag end of the tension spring, and the second tag end of the tension spring in the closed position thereof retained by the clasp forming the closed loop; and a cam formed in the second end of the connector to interact with the cam surface formed in the clasp to maintain the clasp cover in the second position.

13. The security locking device according to claim 12, wherein the first tag end of the tension spring extends into, and is secured within, a socket formed in the clasp.

14. The security locking device according to claim 12, further comprising an opening formed in the clasp cover through which the clasp passes in response to movement of the clasp cover between the first and second positions with respect to the clasp.

* * * * *